US011877598B2

(12) United States Patent
Wang et al.

(10) Patent No.: US 11,877,598 B2
(45) Date of Patent: Jan. 23, 2024

(54) POWER MECHANISM AND ELECTRONIC ATOMIZING DEVICE USING SAME

(71) Applicant: SHENZHEN FIRST UNION TECHNOLOGY CO., LTD., Shenzhen (CN)

(72) Inventors: Kuan Wang, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 250 days.

(21) Appl. No.: 17/524,714

(22) Filed: Nov. 11, 2021

(65) Prior Publication Data

US 2022/0151296 A1 May 19, 2022

(30) Foreign Application Priority Data

Nov. 13, 2020 (CN) ..... 202022632864.9

(51) Int. Cl.

| | |
|---|---|
| ***A24F 40/46*** | (2020.01) |
| ***A24F 40/90*** | (2020.01) |
| ***A24F 40/51*** | (2020.01) |
| ***A24F 40/10*** | (2020.01) |
| ***A24F 40/50*** | (2020.01) |

(52) U.S. Cl.
CPC ..... *A24F 40/46* (2020.01); *A24F 40/10* (2020.01); *A24F 40/51* (2020.01); *A24F 40/90* (2020.01)

(58) Field of Classification Search
CPC ..... A24F 40/46; A24F 40/90; A24F 40/51
See application file for complete search history.

(56) References Cited

U.S. PATENT DOCUMENTS

2017/0215484 A1* 8/2017 Xiang ..... A24F 47/008

* cited by examiner

*Primary Examiner* — Michael J Felton
*Assistant Examiner* — Ronnie Kirby Jordan
(74) *Attorney, Agent, or Firm* — Cheng-Ju Chiang

(57) ABSTRACT

An electronic atomizing device includes a battery cell, a heating element, a charging socket used for power charging the battery cell, and an airflow sensor used for measuring airflows flowing through the electronic atomizing device and being formed by inhaling of users. The airflow sensor includes a first port and a second port. The first port includes two electrical connections. A first electrical connection is electrically connected with a positive electrode of the charging socket, and a second electrical connection is electrically connected with the heating element via a switch transistor. The second port is electrically connected with a positive electrode of the battery cell. The switch transistor is disposed to be switched on when the positive electrode of the charging socket is at a low voltage level, and disposed to be switched off when the positive electrode of the charging socket is at a high voltage level.

14 Claims, 2 Drawing Sheets

POWER MECHANISM AND ELECTRONIC ATOMIZING DEVICE USING SAME

BACKGROUND OF THE INVENTION

Field of the Invention

The present invention relates to a technical field of atomizing equipment, particularly relates to an electronic atomizing device and a power mechanism used in the electronic atomizing device.

Description of Related Art

Smoking products (such as cigarettes and cigars, etc.) is used to burn tobacco to generate tobacco smoke. People try to replace these tobacco-burning products by manufacturing products that release tobacco compounds without burning.

Examples of such products are heating devices that release tobacco compounds by heating material rather than burning materials. For example, the material may be tobacco or other non-tobacco products. These non-tobacco products may or may not contain nicotine. As another example, aerosol-providing products are provided in the market, such as so-called electronic atomization devices. These devices usually contain a liquid. The liquid is heated to be atomized and thereby inhalable vapors or aerosols are generated. The liquid may contain nicotine and/or fragrances and/or aerosol generating substances (For example, glycerin).

BRIEF SUMMARY OF THE INVENTION

An electronic atomizing device in accordance with a preferred embodiment of the present invention is provided to be arranged for heating and atomizing an aerosol substrate to generate aerosols. The electronic atomizing device includes a battery cell, a heating element for heating the aerosol substrate to generate aerosols, a charging socket used for power charging the battery cell, and an airflow sensor used for measuring airflows flowing through the electronic atomizing device and being formed by inhaling of users. The airflow sensor includes a first port and a second port. The first port of the airflow sensor includes two electrical connections. A first electrical connection of the two electrical connections is electrically connected with a positive electrode of the charging socket, and a second electrical connection of the two electrical connections is electrically connected with the heating element via a switch transistor. The second port of the airflow sensor is electrically connected with a positive electrode of the battery cell. The switch transistor is disposed to be switched on when the positive electrode of the charging socket is at a low voltage level in order for electrically connecting the first port of the airflow sensor with the heating element, and disposed to be switched off connection between the first port of the airflow sensor and the heating element when the positive electrode of the charging socket is at a high voltage level.

In a preferred embodiment of the present invention, the electronic atomizing device further includes a diode. The first port of the airflow sensor is electrically connected with the positive electrode of the charging socket through the diode. The diode is disposed to allow electric currents flowing from the positive electrode of the charging socket toward the first port of the airflow sensor.

In a preferred embodiment of the present invention, the airflow sensor is disposed to electrically connect the first port and the second port in order to make the charging socket power charging the battery cell when the positive electrode of the charging socket is at the high voltage level.

In a preferred embodiment of the present invention, the airflow sensor is disposed to electrically connect the first port and the second port in order to make the battery cell outputting power to the heating element when the positive electrode of the charging socket is at the low voltage level, and the measured airflows are larger than a preset threshold value.

In a preferred embodiment of the present invention, a controlled end of the switch transistor has two electrical connections. A first electrical connection of the two electrical connections is electrically connected with the positive electrode of the charging socket. A second electrical connection of the two electrical connections is grounded through a first resistor. The switch transistor is switched on when the positive electrode of the charging socket is at the low voltage level, and is switched off when the positive electrode of the charging socket is at the high voltage level.

In a preferred embodiment of the present invention, a resistance value of the first resistor is larger than an equivalent resistance value of a power charging circuit loop formed by the charging socket and the battery cell.

In a preferred embodiment of the present invention, the resistance value of the first resistor is 10 times larger than the equivalent resistance value of the power charging circuit loop.

In a preferred embodiment of the present invention, the resistance value of the first resistor is larger than 5 KΩ.

In a preferred embodiment of the present invention, the airflow sensor further includes a third port electrically connected with a negative electrode of the battery cell in order to allow the battery cell supplying power to the airflow sensor.

A power mechanism used for an electronic atomizing device in accordance with further another preferred embodiment of the present invention is provided to supply power to an atomizer of the electronic atomizing device. The atomizer includes a heating element. The power mechanism includes a battery cell, a charging socket used for power charging the battery cell, and an airflow sensor used for measuring airflows flowing through the electronic atomizing device and being formed by inhaling of users. The airflow sensor includes a first port and a second port. The first port of the airflow sensor includes two electrical connections. A first electrical connection of the two electrical connections is electrically connected with a positive electrode of the charging socket, and a second electrical connection of the two electrical connections is electrically connected with the heating element of the atomizer via a switch transistor. The second port of the airflow sensor is electrically connected with a positive electrode of the battery cell. The switch transistor is disposed to be switched on when the positive electrode of the charging socket is at a low voltage level in order for electrically connecting the battery cell with the heating element of the atomizer, and disposed to be switched off connection between the battery cell and the heating element when the positive electrode of the charging socket is at a high voltage level.

The power mechanism having the above components through the above circuit structure is able to be equipped with the airflow sensor with the above integrated functions not only for airflow sensing and measuring, but also for management of power charging and outputting of the battery cell. A circuit of the power mechanism can be saved from using any main control chip MCU and any single charging IC in order to simplify a circuit structure of the power mechanism.

BRIEF DESCRIPTION OF THE DRAWINGS

One or more embodiments in accordance with the present invention are illustratively exemplified for explanation through figures shown in the corresponding attached drawings. These exemplified descriptions do not constitute any limitation on the embodiments. The elements with the same reference numerals in the attached drawings are denoted as similar elements. Unless otherwise stated, the figures in the attached drawings do not constitute any scale limitation.

DETAILED DESCRIPTION OF THE INVENTION

In order to facilitate best understanding of the present invention, the present invention will be illustrated in more detail below in conjunction with the attached drawings and preferred embodiments.

Figure 1:
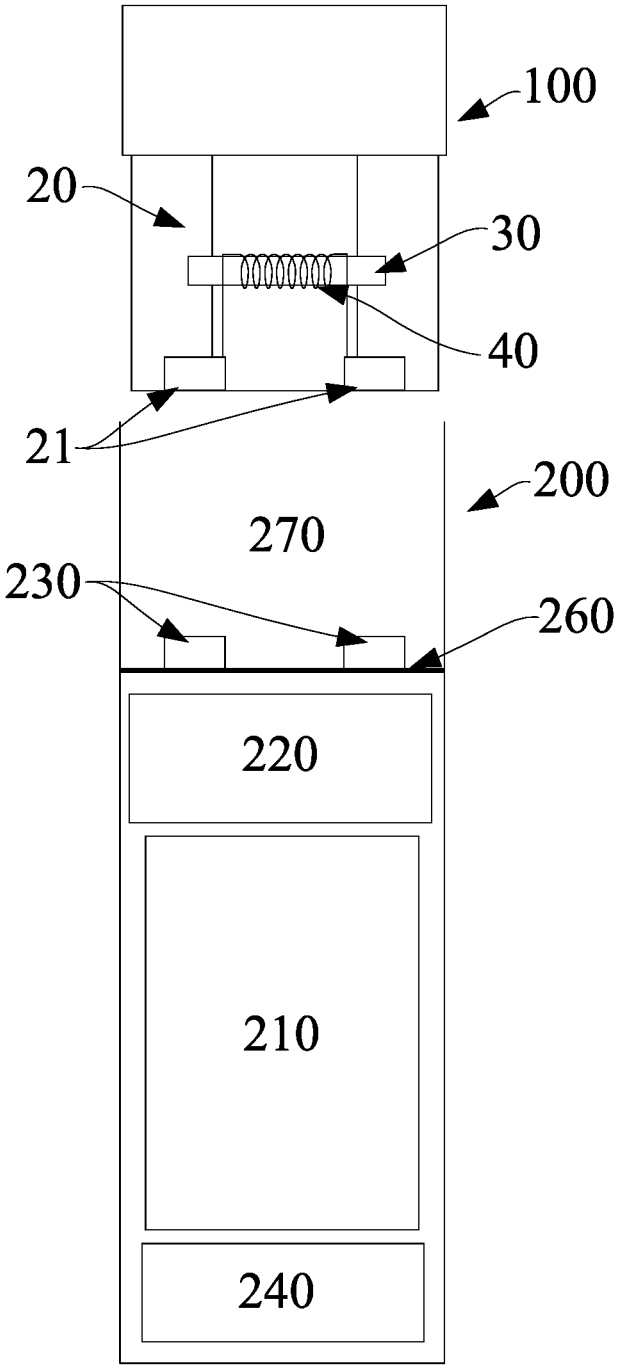
FIG. 1 shows a schematic cross sectional view of an electronic atomizing device in accordance with a preferred embodiment of the present invention.

An electronic atomizing device in accordance with a preferred embodiment of the present invention is provided. Referring to FIG. 1 for a structure of the electronic atomizing device, the electronic atomizing device includes an atomizer 100 for storing a liquid substrate and for atomizing the stored liquid substrate to generate aerosols, and a power mechanism 200 for powering the atomizer 100.

In a preferred embodiment of the present invention, as shown in FIG. 1 as an example, the power mechanism 200 includes a receiving cavity 270 and first electric contacts 230. The receiving cavity 270 is disposed at an end of the power mechanism 200 along a lengthwise direction of the power mechanism 200, and is used to receive and accommodate at least a portion of the atomizer 100. The first electric contacts 230 are at least partially exposed on a surface of the receiving cavity 270 in order to power the atomizer 100 after electrical connection is formed between the first electric contacts 230 and the atomizer 100 when the at least a portion of the atomizer 100 is received and accommodated in the power mechanism 200.

According to a preferred embodiment of the present invention as shown in FIG. 1, second electric contacts 21 are disposed at an end portion of the atomizer 100 along a lengthwise direction of the atomizer 100 corresponding to the power mechanism 200. As a result, when the at least a portion of the atomizer 100 is received and accommodated in the receiving cavity 270, the second electric contacts 21 are respectively electrically contacted and engaged with the first electric contacts 230 to form electrical conduction.

A sealing piece 260 is disposed in the power mechanism 200. The sealing piece 260 is used to partition off at least a portion of an inner space of the power mechanism 200 to form the receiving cavity 270. In a preferred embodiment of the present invention as shown in FIG. 1, the sealing piece 260 is structured as extending along a transverse direction of the power mechanism 200, and is made from flexible material in order to prevent a liquid substrate, which is percolated from the atomizer 100 to the receiving cavity 270, from flowing toward parts, such as an airflow sensor 220, etc., disposed inside the power mechanism 200.

In a preferred embodiment of the present invention as shown in FIG. 1, the power mechanism 200 further includes a battery cell 210 and the airflow sensor 220. The battery cell 210 is disposed close to another end of the power mechanism 200 along the lengthwise direction of the power mechanism 200 opposite to the receiving cavity 270, and is used for power supply. The airflow sensor 220 is disposed between the battery cell 210 and the receiving cavity 270. The airflow sensor 220 is to sense airflows of the atomizer 100 generated due to inhaling in order for detecting and sensing inhaling motions of users. Conduction of electrical currents is therefore operable based on the detected and sensed inhaling motions.

Further in a preferred embodiment of the present invention as shown in FIG. 1, the power mechanism 200 includes a charging socket 240 disposed at the another end of the power mechanism 200 opposite to the receiving cavity 270. The charging socket 240 is used to electrically connect with external charging equipment in order for charging the battery cell 210. The charging socket 240 commonly used includes a USB-Type C (universal serial bus-Type C) socket, a USB-Mini socket or a USB-4p/5p (4 pins/5 pins) type socket.

Further in a preferred embodiment of the present invention as shown in FIG. 1, the atomizer includes a liquid storage cavity 20 used for storing a liquid substrate, a liquid conducting element 30 and a heating element 40. The heating element 40 is used to heat and atomize the liquid substrate of the liquid storage cavity 20 to generate aerosols for inhaling. The liquid conducting element 30 is made from material having capillary channels or pores, such as hard or rigid capillary structures including fiber cotton, a porous ceramic body, a fiberglass cord, porous glass ceramic, porous glass, etc. A portion of the liquid conducting element 30 extends partially in the liquid storage cavity 20 to absorb the liquid substrate in the liquid storage cavity 20. Another portion of the liquid conducting element 30 is connected with the heating element 40 in order to conduct the liquid substrate absorbed from the liquid storage cavity 20 to the heating element 40.

In a preferred embodiment of the present invention as shown in FIG. 1, the liquid conducting element 30 is structured as pole-shaped, rod-shaped and strip-shaped, etc., to extend along a transverse direction of the atomizer 100. The heating element 40 is structured as coil-shaped to wrap around at least a portion of the liquid conducting element 30. In other embodiments in accordance with the present invention, the liquid conducting element 30 can be a regular or irregular shape such as lump-shaped and plate-shaped, etc. At least a portion of the liquid conducting element 30 is fluidically communicated with the liquid storage cavity 20, and another portion of the liquid conducting element 30 is connected with the heating element 40 in order to conduct the liquid substrate absorbed from the liquid storage cavity 20 to the heating element 40.

Figure 2:
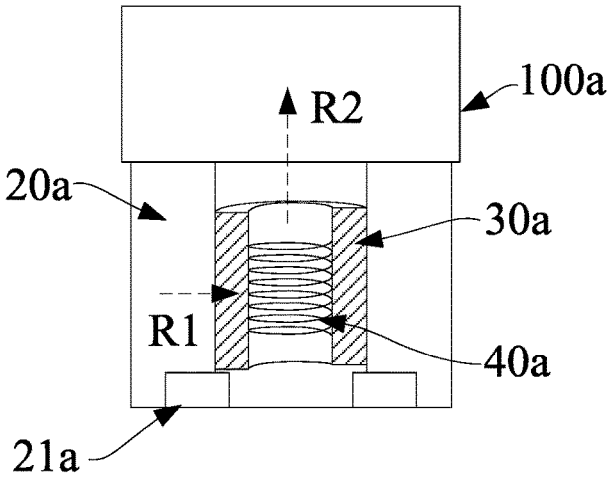
FIG. 2 shows a schematic structural cross sectional view of an atomizer in accordance with further another preferred embodiment of the present invention.

FIG. 2 is a schematic structural view to show further another exemplified commonly-used atomizer 100*a*. In FIG. 2, a liquid conducting element 30*a* is structured as a shape of a hollow column extending along a lengthwise direction of the atomizer 100*a*. A heating element 40*a* is formed inside the hollow column of the liquid conducting element 30*a* and is electrically connected with second electric contacts 21*a*.

In use, as shown as an arrow R1 in FIG. 2, the liquid substrate in a liquid storage cavity 20*a* is absorbed at an outer surface of the liquid conducting element 30*a* along a radial direction of the liquid conducting element 30*a*. The absorbed liquid substrate is then transferred to the heating element 40*a* at an inner surface of the liquid conducting element 30*a* for heating and atomizing to generate aerosols. The generated aerosols are output from a columnar hollow of the liquid conducting element 30*a* along a lengthwise direction of the liquid conducting element 30*a*, as an arrow R2 shown in FIG. 2.

In other verified embodiments of the present invention, the liquid conducting element 30/30*a* can be a plane or a curve face for supporting the heating element 40/40*a*. The heating element 40/40*a* is formed on the plane or the curve face of the liquid conducting element 30/30*a* through manufacturing methods including surface mounting, printing, depositing, etc. The heating element 40/40*a*, in some embodiments of the present invention, can be made from materials including stainless steel, nickel chromium alloy, ferro chromium aluminum alloy and titanium metal, etc.

In the above embodiment of the present invention, the airflow sensor 220 in the power mechanism 200 as shown in FIG. 1 is integrated to have functions of airflow sensing, power charging and power output control, etc. Hence, in practice, the power mechanism 200 does not have a single charging integrated circuit (IC) and a single main control chip (multipoint control unit, MCU).

Figure 3:
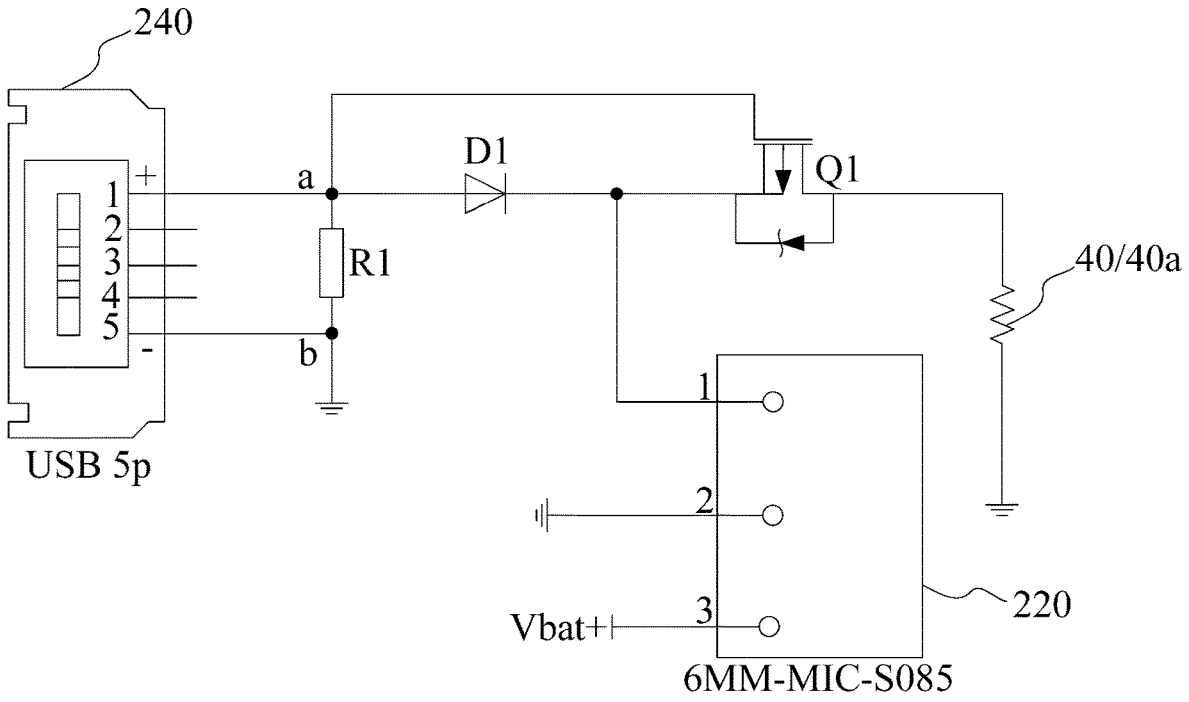
FIG. 3 shows a schematic structural diagram of basic components of a circuit of a power mechanism shown in FIG. 1 in accordance with a preferred embodiment of the present invention.

In a preferred embodiment of the present invention as shown in FIG. 3, the airflow sensor 220 is a microphone sensor with three input/output (I/O) ports and a model number of 6MM-MIC-S085. The airflow sensor 220 can sense and measure inhaling airflows, and have integrated functions of switching management of power charging and discharging. In order to realize the above functions, every component in a circuit of the power mechanism 200 and its electrical connection are shown in FIG. 3, and these connections are described as below. An I/O port 1 of the airflow sensor 220 is electrically connected with a positive electrode of a USB-5p type charging socket 240 via a diode D1. An I/O port 2 of the airflow sensor 220 is grounded. An I/O port 3 of the airflow sensor 220 is electrically connected with a positive electrode of the battery cell 210. The I/O port 3 of the airflow sensor 220 can be used for power charging the battery cell 210, and also used for discharging to output power. The I/O port 1 of the airflow sensor 220 is further electrically connected with a first end of the heating element 40/40*a* via a switch transistor Q1. The positive electrode of the battery cell 210 can output power to the heating element 40/40*a* through the I/O port 1 of the airflow sensor 220. In the meantime, in order to form a close circuit of the circuit of the power mechanism 200, a negative electrode of the battery cell 210 and a second end of the heating element 40/40*a* are both grounded.

Referring to FIG. 3, the I/O port 2 and I/O port 3 of the airflow sensor 220 are respectively electrically connected with the positive electrode and negative electrode of the battery cell 210 in order to allow battery cell 210 to supply power to the airflow sensor 220.

In order to facilitate automatic switch of the switch transistor Q1 between a power charging state and a power output state of the power mechanism 200, a controlled end of the switch transistor Q1 is electrically conducted by being clamped at a low-level voltage by electrically connecting a pull-down resistor R1. For physical electrical connection, the controlled end of the switch transistor Q1 is electrically connected with the positive electrode of the USB-5p type charging socket 240 on the one hand, and is grounded via the resistor R1 at the same time on the other hand.

In the preferred embodiment of the present invention as shown in FIG. 3, for facilitate all components of the power mechanism 200 electrically connecting to one another, a commonly connective node a is included in the circuit of the power mechanism 200 and is electrically connected with the positive electrode of the charging socket 240. Other components described above are respectively electrically connected with the positive electrode of the charging socket 240 through the commonly connective node a. A commonly connective node b is grounded. A negative electrode of the charging socket 240 is electrically connected with the commonly connective node b. Two ends of the resistor R1 are respectively electrically connected with the commonly connective node a and the commonly connective node b.

Furthermore, a process of electrical conduction and switch of the circuit of the power mechanism 200 as shown in FIG. 3 in different states is described as follows. In a step of S10, when the charging socket 240 is not electrically connected with any external power plug, no voltage exists at the charging socket 240. In other words, the positive electrode of the charging socket 240 is grounded through the resistor R1, and therefore a voltage of the positive electrode of the charging socket 240 is 0 V.

At this moment, the controlled end of the switch transistor Q1 is also clamped at a low-level voltage via the resistor R1 being grounded. As a result, the switch transistor Q1 is switched on and is in an electrical connection state. In the switched-on state, if inhaling airflows of users are sensed by the airflow sensor 220, the I/O port 1 and the I/O port 3 of the airflow sensor 220 are triggered to be electrically connected. At this moment, the positive electrode of the battery cell 210 output power to the heating element 40/40*a* through the I/O port 1 of the airflow sensor 220 and the switched-on switch transistor Q1.

Of course, due to existence of the diode D1 which is able to limit reverse electric currents, the above output power will not be reversely supplied to the commonly connective node a to change the switched-on state of the switch transistor Q1.

In a step of S20, when the charging socket 240 is electrically connected with an external power supply equipment through a power charging plug, a voltage exists at the positive electrode of the charging socket 240. Usually a voltage commonly used for a USB-5p socket applicable to electronic atomizing equipment is 5.0 V.

At this moment, due to existence of the resistor R1, a voltage of the commonly connective node a which is electrically connected with the positive electrode of the charging socket 240 will not be pulled down to a ground voltage, 0 V. Instead, the voltage of the commonly connective node a is equal to 5.0 V, the voltage of the positive electrode of the charging socket 240. As a result, the switch transistor Q1 is changed to a switched-off state, and the positive electrode of the charging socket 240 charges power to the positive electrode of the battery cell 210 through the diode D1, and the I/O port 1 and the I/O port 3 of the airflow sensor 220.

Furthermore, in the above embodiment of the present invention, during a power charging process of the power mechanism 200, the positive electrode of the charging socket 240 further forms a circuit loop via being grounded through the resistor R1. If a resistance value of the resistor R1 is smaller than an equivalent resistance of a power charging circuit loop of the positive electrode of the charging socket 240, electric currents will be mostly shunted by the resistor R1 to significantly affect a power charging efficiency of the power mechanism 200. Based on the above situation, in a preferred embodiment of the present invention, a large resistance with a larger resistance value is adopted for the resistor R1. Basically, the resistance value of the resistor R1 is preferable to be 10 times larger than an equivalent resistance value of the power charging circuit loop of the positive electrode of the charging socket 240. Particularly, the resistance value of the resistor R1 is preferable to be larger than 5 KΩ. In a physical product embodiment of the present invention, a standard resistance of 10 KΩ much larger in a resistance value is selected for the resistor R1. As a result, the circuit loop of the positive electrode of the charging socket 240 through the resistor R1 is in an electrically connected state with a little amount of electric currents passing through. Hence, the resistor R1 can mainly function to pull down a voltage of the controlled end of the switch transistor Q1 for being in its electrical connection state when the charging socket 240 is not electrically connected with any external power plug.

The power mechanism 200 having the above components through the above circuits is able to be equipped with the airflow sensor 220 with the above integrated functions not only for airflow sensing and measuring, but also for management of power charging and outputting of the battery cell 210. Hence, the whole circuit of the power mechanism 200 can be saved from using any main control chip MCU and any single charging IC. In other varying embodiments of the present invention, the airflow sensor 220 can further be a microphone sensor with a model number of 7MM-MIC-S087 and a microphone sensor with a model number of DWS-1-5-FKM, etc.

It should be noted that the specification of the present invention and its accompanying drawings provides preferred embodiments of the present invention. However, the present invention can be implemented in many different forms and is not limited to the preferred embodiments described in this specification. Furthermore, for those of ordinary skill in the art, improvements or transformations can be made based on the above descriptions, and all these improvements and transformations should belong to the protection scope of the appended claims of the present invention.

What is claimed is:

1. An electronic atomizing device for heating an aerosol substrate to generate aerosols, comprising:

a battery cell;

a heating element used for heating the aerosol substrate to generate aerosols;

a charging socket used for power charging the battery cell; and an airflow sensor used for measuring airflows flowing through the electronic atomizing device and being formed by inhaling of users, the airflow sensor comprising a first port and a second port; wherein the first port of the airflow sensor comprises two electrical connections, a first electrical connection of the two electrical connections is electrically connected with a positive electrode of the charging socket, and a second electrical connection of the two electrical connections is electrically connected with the heating element via a switch transistor, the second port of the airflow sensor is electrically connected with a positive electrode of the battery cell;

the switch transistor is disposed to be switched on when the positive electrode of the charging socket is at a low voltage level in order for electrically connecting the first port of the airflow sensor with the heating element, and disposed to be switched off connection between the first port of the airflow sensor and the heating element when the positive electrode of the charging socket is at a high voltage level.

2. The electronic atomizing device as claimed in claim 1, further comprising:

a diode, wherein the first port of the airflow sensor is electrically connected with the positive electrode of the charging socket through the diode, the diode is disposed to allow electric currents flowing from the positive electrode of the charging socket toward the first port of the airflow sensor.

3. The electronic atomizing device as claimed in claim 1, wherein the airflow sensor is disposed to electrically connect the first port and the second port in order to make the charging socket power charging the battery cell when the positive electrode of the charging socket is at the high voltage level.

4. The electronic atomizing device as claimed in claim 2, wherein the airflow sensor is disposed to electrically connect the first port and the second port in order to make the charging socket power charging the battery cell when the positive electrode of the charging socket is at the high voltage level.

5. The electronic atomizing device as claimed in claim 1, wherein the airflow sensor is disposed to electrically connect the first port and the second port in order to make the battery cell outputting power to the heating element when the positive electrode of the charging socket is at the low voltage level, and the measured airflows are larger than a preset threshold value.

6. The electronic atomizing device as claimed in claim 2, wherein the airflow sensor is disposed to electrically connect the first port and the second port in order to make the battery cell outputting power to the heating element when the positive electrode of the charging socket is at the low voltage level, and the measured airflows are larger than a preset threshold value.

7. The electronic atomizing device as claimed in claim 1, wherein a controlled end of the switch transistor comprises two electrical connections, a first electrical connection of the two electrical connections is electrically connected with the positive electrode of the charging socket, a second electrical connection of the two electrical connections is grounded through a first resistor, the switch transistor is switched on when the positive electrode of the charging socket is at the low voltage level, and is switched off when the positive electrode of the charging socket is at the high voltage level.

8. The electronic atomizing device as claimed in claim 7, wherein a resistance value of the first resistor is larger than an equivalent resistance value of a power charging circuit loop formed by the charging socket and the battery cell.

9. The electronic atomizing device as claimed in claim 8, wherein the resistance value of the first resistor is 10 times larger than the equivalent resistance value of the power charging circuit loop.

10. The electronic atomizing device as claimed in claim 8, wherein the resistance value of the first resistor is larger than 5 KΩ.

11. The electronic atomizing device as claimed in claim 2, wherein a controlled end of the switch transistor comprises two electrical connections, a first electrical connection of the two electrical connections is electrically connected with the positive electrode of the charging socket, a second electrical connection of the two electrical connections is grounded through a first resistor, the switch transistor is switched on when the positive electrode of the charging socket is at the low voltage level, and is switched off when the positive electrode of the charging socket is at the high voltage level.

12. The electronic atomizing device as claimed in claim 1, wherein the airflow sensor further comprises a third port electrically connected with a negative electrode of the battery cell in order to allow the battery cell supplying power to the airflow sensor.

13. The electronic atomizing device as claimed in claim 2, wherein the airflow sensor further comprises a third port electrically connected with a negative electrode of the battery cell in order to allow the battery cell supplying power to the airflow sensor.

14. A power mechanism used for an electronic atomizing device to supply power to an atomizer of the electronic atomizing device, the atomizer comprising a heating element, the power mechanism comprising:

a battery cell;

a charging socket used for power charging the battery cell; and an airflow sensor used for measuring airflows flowing through the electronic atomizing device and being formed by inhaling of users, the airflow sensor comprising a first port and a second port; wherein the first port of the airflow sensor comprises two electrical connections, a first electrical connection of the two electrical connections is electrically connected with a positive electrode of the charging socket, and a second electrical connection of the two electrical connections is electrically connected with the heating element of the atomizer via a switch transistor, the second port of the airflow sensor is electrically connected with a positive electrode of the battery cell;

the switch transistor is disposed to be switched on when the positive electrode of the charging socket is at a low voltage level in order for electrically connecting the battery cell with the heating element of the atomizer, and disposed to be switched off connection between the battery cell and the heating element when the positive electrode of the charging socket is at a high voltage level.

* * * * *